United States Patent [19]

Davis et al.

[11] Patent Number: 5,045,375

[45] Date of Patent: Sep. 3, 1991

[54] NONSKID POLYURETHANE COATING

[75] Inventors: William L. Davis, Rocky Face; Stanley M. Printz, Lafayette; Timothy W. Brown, Dalton, all of Ga.

[73] Assignee: Standard Adhesive & Chemical Co., Inc., Dalton, Ga.

[21] Appl. No.: 334,363

[22] Filed: Apr. 7, 1989

[51] Int. Cl.[5] ..... B32B 33/00

[52] U.S. Cl. ..... 428/96; 428/97; 427/261; 427/186; 427/381; 427/389.9; 427/412

[58] Field of Search ..... 427/389.9, 261, 286, 427/381, 412; 428/95, 96, 97

[56] References Cited

U.S. PATENT DOCUMENTS 3,846,364 11/1974 Criddle et al. ..... 428/338 X 4,657,790 4/1987 Wing et al. ..... 428/95 X

*Primary Examiner*—Michael Lusignan

*Attorney, Agent, or Firm*—James B. Middleton

[57] ABSTRACT

A nonskid coating for a carpet or mat is provided by placing a patterned polyurethane on the carpet, the polyurethane being permanently tacky. The method includes the steps of forming a precoat coating of one reactive formulation and forming a secondary coating of a second reactive formulation. The one reactive formulation is a polyurethane for holding face yarns in the carpet backing, and the second reactive formulation includes a diamine to render the formulation thixotropic and a tackifier for rendering the cured polyurethane tacky.

14 Claims, 2 Drawing Sheets

NONSKID POLYURETHANE COATING

INFORMATION DISCLOSURE STATEMENT

It is well known to provide a coating on textiles such as carpeting, the coating performing the functions of securing the carpet tufts in the backing, and frequently providing some cushioning for the carpet. In many instances, however, there is a need to prevent the carpet from slipping. In most carpet installations, the carpet is either glued to the surface, or is stretched and held by tack strips or the like. There are other installations, such as floor mats for automobiles and rugs in entry or work areas, that cannot be reasonably glued down or tacked into place.

The prior art solution to the problem of the slippage of the area rug or automobile floor mat has been to provide downwardly protruding studs that will engage the floor covering and prevent slipping of the mat or rug. While such studs achieve some degree of success, their use requires a somewhat rigid material that will provide studs strong enough to hold against the exerted lateral forces. It will also be understood that such studs can be painful to handle, and difficult to work with in a pile carpet.

SUMMARY OF THE INVENTION

This invention relates generally to coatings for carpets and the like, and is more particularly concerned with a method and apparatus for providing a nonskid coating on carpets and other substrates.

The present invention provides a method and apparatus wherein a carpet or other substrate is precoated to adhere the face yarns to the backing and to provide dimensional stability and the like. A second, nonskid coating is applied to the precoat, the nonskid coating comprising a blend of a polyurea compound and a polyurethane, including a tackifier to render the nonskid coating sufficiently tacky to grip a surface.

The method of the present invention includes the steps of preparing a precoat and applying the precoat to the substrate in a coating of a predetermined thickness, preparing a nonskid coating comprising the components of a polyurethane, and including a fast reacting means for forming a polyurea to render the nonskid coating thixotropic. The thixotropic nonskid coating material can be manipulated as required to achieve the desired form of coating on the first coating, and the nonskid coating will remain as formed until the material is fully cured by passing through a curing oven or the like.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
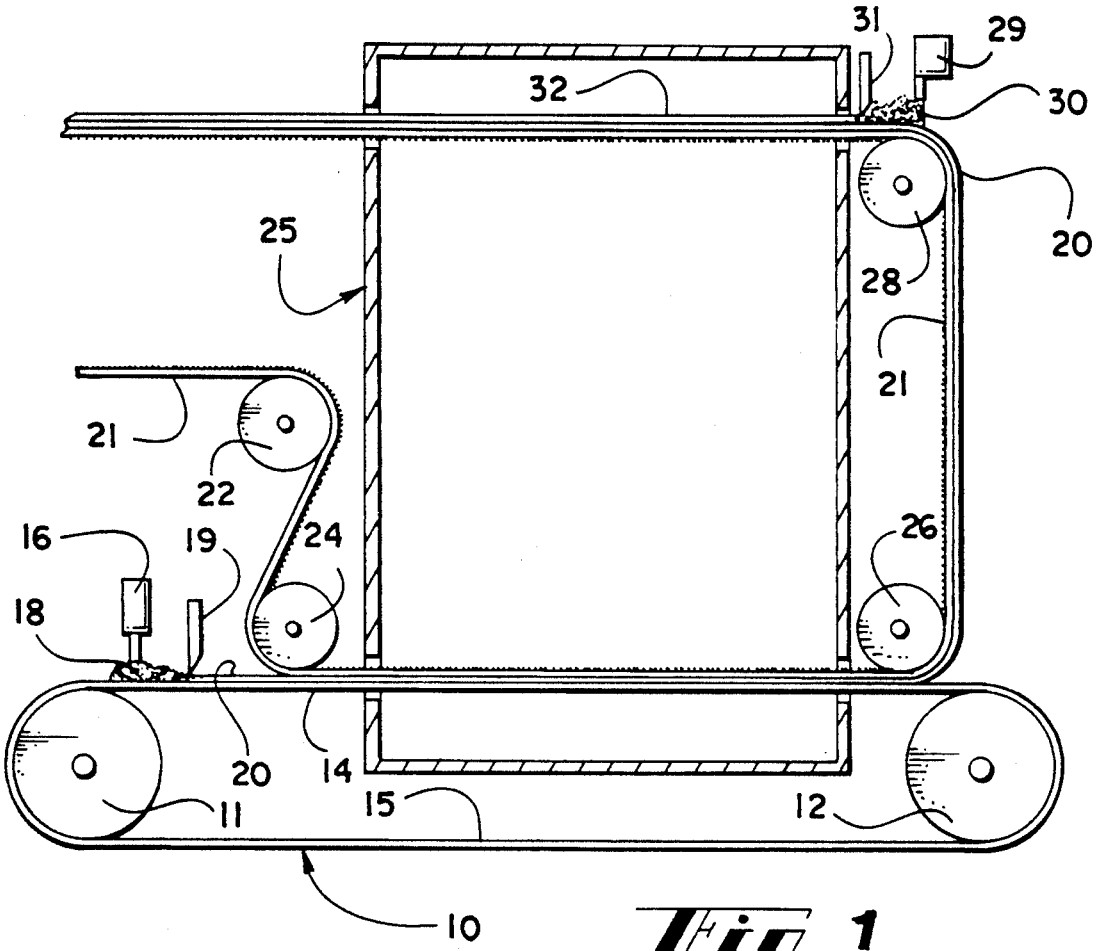
FIG. 1 is a somewhat schematic, side elevational view illustrating one system for carrying out the method of the present invention for producing the nonskid carpet of the present invention.

Referring now more particularly to the drawings, and to those embodiments of the invention here presented by way of illustration, in FIG. 1 there is a conveyor belt generally designated at 10, the belt 10 being trained over rollers 11 and 12. The belt 10 will be of a material to which a polyurethane material will not readily adhere, or the belt may be covered with a release paper. As is known in the art, a belt coated with polytetraflouroethylene (PTFE) is one type of belt that is recommended for such use. The belt 10 includes an upper flight 14 and a lower flight 15; and, at one end of the upper flight 14, there is a mixing head designated at 16.

The mixing head 16 is well understood by those skilled in the art, and may be of the impinging type, or a static mixer. In the mixing apparatus, the A and B portions of the polyurethane material are fed to the mixing heads 16, and the materials are intimately mixed by the mixing head and promptly dispensed to the upper flight 14 of the belt 10. The dispensed material is indicated at 18 and it will be seen that a doctor blade 19 doctors the puddle 18 to a uniform coating indicated at 20.

Those skilled in the art will understand that the polyurethane material usually contains a catalyst that will cause reaction of the materials to form a polyurethane. The substrate must be married to the coating before the polyurethane is fully cured so the material will still be tacky. As will be discussed in more detail hereinafter, the polyurethane material used as the precoat includes a sufficiently small amount of catalyst that a very long time would be required for the material to cure at room temperature. This fact allows much more manipulation of the coating, but generally creates difficulties in handling.

Looking further at FIG. 1 of the drawings, it will be seen that a substrate is supplied at 21, the substrate 21 passing over a roller 22 which directs the substrate towards the upper flight 14 of the belt 10. Adjacent to the belt 10, a second roller 24 is positioned to marry the substrate 21 to the coating 20 carried on the upper flight 14 of the belt 10. After the substrate 21 is married to the coating 20, the coating 20 is at least partially cured by passing through a curing oven 25.

As the conveyor belt 10, with the substrate 21 and coating 20 thereon, leaves the curing oven 25, it will be understood that the coating 20 has been substantially cured and is adhered to the substrate 20. Since the release paper, or belt 10 does not well adhere to the coating 20, the substrate 21 can be carried upwardly around the roller 26, and the coating 20 will leave the belt 10 and remain on the substrate 21. Therefore, at this point the substrate 21 has been provided with a first coating, or a precoat, 20, the precoat 20 preferably being only partially cured, but sufficiently so to have reasonable dimensional stability to withstand the further handling.

After passing over the roller 26, the precoated textile material passes over an upper roller 28. It will be noted that the face of the substrate 21 engages the roller 28 so that the backing faces upwardly. The second coat, or nonskid coat, is therefore applied to the coating 20.

As before, there is a mixer, of either the impinging type, or a static mixer. As here shown, there is a mixing head 29 to which components for forming a polyurethane material are fed, the components being thoroughly mixed and dispensed in the form of a puddle 30. The puddle 30 is appropriately doctored by the doctor blade 31 to provide a predetermined thickness of nonskid coating 32.

At this point it should be understood that the nonskid coating 32 may be a uniform coating over the entire carpet if desired. Alternatively, the nonskid coating can be applied in the form of ribs or the like, and including various discrete shapes placed throughout the back of the carpeting. If a doctor blade such as a doctor blade 31 is used, it will be readily understood that the doctor blade can be notched and placed against the coating 20 so that all of the nonskid coating will be removed except the material that passes through the notches in the doctor blade 31. Such an application will of course significantly reduce the quantity of material that is required for the nonskid coating 32.

After the nonskid coating 32 is applied to the substrate 21, the material passes through the curing oven 25, and both the coating 20 and the nonskid coating 32 are fully cured. It will be noted that the curing oven 25 here illustrated is a double pass oven. By the use of a double pass oven, it will be recognized that the apparatus can be made somewhat more compact, and of course the double pass oven will be energy saving since only one oven is required. Obviously, two separate ovens could be used, or infrared or other heating means might be utilized for one or both of the curing steps.

From the foregoing general description, it should be understood that the nonskid coating 32 might be applied in many different ways, including printing and the like. One additional technique is illustrated in FIG. 2 of the drawings.

Figure 2:
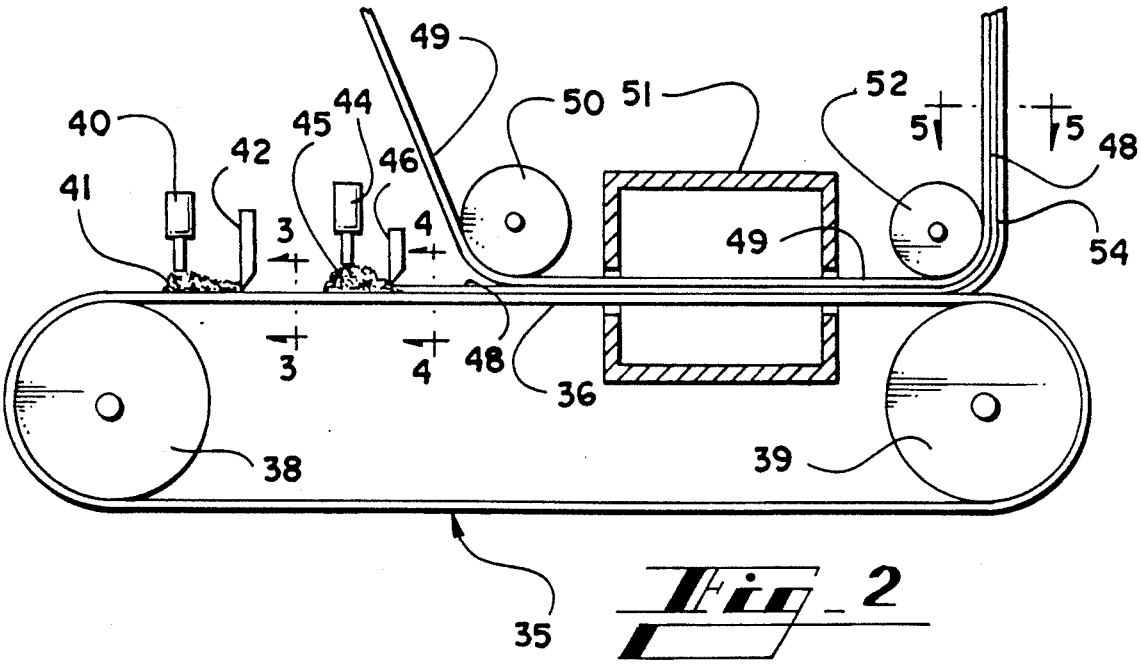
FIG. 2 is a view similar to FIG. 1 showing a modified system.

FIG. 2 illustrates a conveyor generally designated at 35 comprising a belt 36 trained over rollers 38 and 39. The belt 36 is a relatively thick belt formed of, for example, a fiberglass reinforced plastic material, the belt 36 having an intaglio pattern formed therein. The belt and the pattern are then coated with a release material such as PTFE.

With the belt 36 trained over the rollers 38 and 39, a mixer 40 dispenses a puddle 41 onto the belt 36. A doctor knife, or screed, 42 removes all of the material from the belt 36 except the material that is within the intaglio pattern. It will be understood that this first-applied material is the nonskid coating equivalent to the coating 32 described in FIG. 1 of the drawings.

After a very short wait, the precoat material is dispensed by a mixing head 44 to provide a puddle 45 on the belt 36. The puddle 45 is doctored by a doctor blade 46 to a uniform thickness to provide a coating 48.

After the coating 48 is provided, and before the coating 48 is fully cured, a substrate 49 is married to the coating by a roller 50. It will therefore be understood that the substrate 49 is directly adhered to the precoat 48; and, the nonskid coating is adhered to the precoat 48, the nonskid coating being within the intaglio pattern of the belt 36. In this condition, the entire combination is passed through a curing oven 51 where both the materials are fully cured.

As the substrate 49 with its cured coating emerges from the curing oven 51, it passes around a roller 52, and the substrate 49 is directed upwardly, carrying the precoat 48 and the nonskid coating 54.

Figure 3:
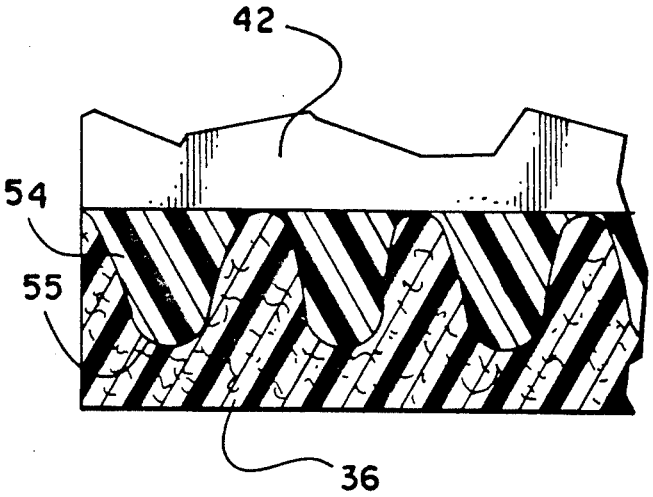
FIG. 3 is an enlarged, fragmentary cross-sectional view taken substantially along the line 3—3 in FIG. 2.

FIG. 3 of the drawings is a much enlarged view showing the belt 36 having the intaglio pattern indicated at 55. In FIG. 3 it will be seen that the nonskid coating is contained within the pattern 55, and is indicated at 54. The doctor blade 42 is also shown, illustrating that all of the material 41 is removed from the belt 46 except the material of the coating 54 contained within the pattern 55.

Figure 4:
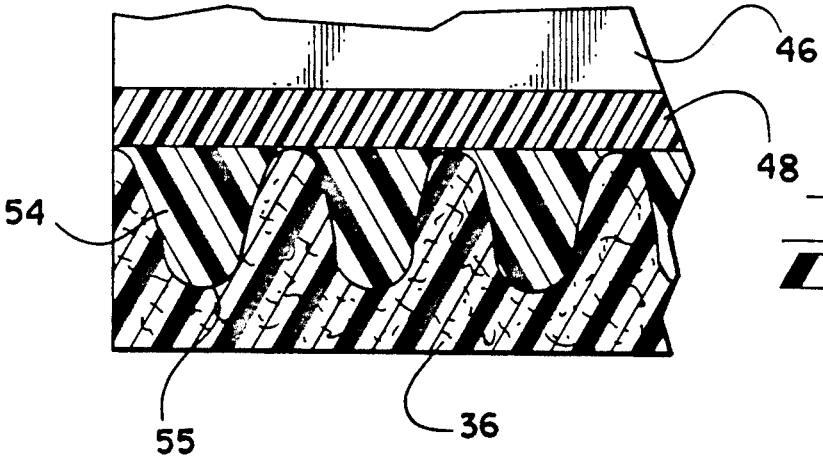
FIG. 4 is a view similar to FIG. 3 taken along the line 4—4 in FIG. 2; and, FIG. 5 is a view similar to FIG. 3 taken along the line 5—5 in FIG. 2.

Looking next at FIG. 4 of the drawings, it will be seen that the precoat 48 has been applied to the belt 36, the precoat 48 engaging the nonskid coating 54 within the pattern 55. In FIG. 4, the doctor blade 46 is illustrated to show the leveling of the coating 48.

Figure 5:
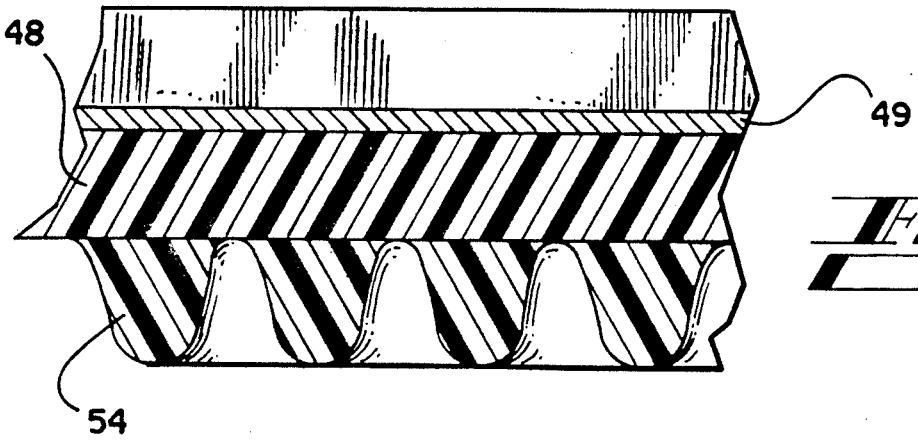

Finally, FIG. 5 shows the substrate 49 with the adhered coatings 48 and 54 after the material has been removed from the belt 36. It will therefore be seen from FIG. 5 of the drawings that the substrate 49 might be the backing material for a carpet or the like, and the precoat 49 can act to adhere the face yarns to the backing fabric for the carpet. The nonskid coating 54 is a separate and additional coatings to the precoat 48, and may be present in just sufficient quantity to provide the desired nonskid characteristics. As is indicated by the shading in FIG. 5, it is contemplated that the ribs of the nonskid coating will form an undulating, sinusoidal, pattern on the back of the material. As was mentioned earlier, virtually any pattern might be used for the nonskid coating.

For purposes of the present application, the coating that is adhered directly to the substrate will be referred to as the precoat, regardless of the order in which the plurality of coatings is formed or applied. Similarly, the coating that acts as the nonskid coating will be referred to as the secondary, or nonskid, coating regardless of the order in which the coatings are formed or applied.

The process of the present invention includes the steps of preparing a mixture for forming a precoat and preparing a second mixture for forming a secondary coat. The precoat is applied to the substrate, and the secondary coat is applied to the precoat, after an appropriate gellation or curing time. When the two coatings have been formed and are on the substrate, the mixtures are fully cured, and the coated substrate is cooled.

The precoat according to the present invention is preferably a polyurethane formed from a di- or polyfunctional organic isocyanate and a di- or poly-functional polyol or blend of polyols. The usual catalyst, pigments, fillers and the like may be added as desired. If desired, the precoat may be any other well known material for providing a smooth or semi-smooth surface on the substrate. Additionally, the nonskid coating may be applied directly to various substrates such as secondary backings for carpets, woven, non-woven or knit films and the like.

By way of example, one successful polyurethane precoat formulation is as follows:

| Component | Parts by Weight |
|---|---|
| Triol, 3600 mol. wt. | 88.0 |
| 1,4 Butane diol | 12.0 |
| Catalyst | 0.5 |
| Calcium carbonate (filler) | 200.0 |
| Pigment | 0.5 |
| Diphenyl Methane Diisocyanate | 47.0 |

It will be recognized that the precoat formulation is such that the material will not cure quickly without the addition of heat to effect curing. A small amount of catalyst is provided, but the reaction mixture allows a significant time for manipulating the coating and marrying the substrate to the coating before the precoat is cured beyond its tacky stage.

The nonskid, or secondary, coating is very important in that the coating must be married to the precoat and must be manipulated to assume the desired form. At the same time, the secondary coating must remain in place, and must retain the desired shape. To achieve these ends, the secondary coating is formed of a di- or poly-functional isocyanate, a di- or poly-functional polyol, and a di- or tri-functional aliphatic or aromatic amine. This yields a blend of a polyurea compound from the amine and a polyurethane compound from the polyol.

The reaction with the amine proceeds rapidly, and forms a thixotropic gel structure which holds the coating in its applied configuration. The urethane reaction is slower, so the thixotropic gel holds the shape and position while the urethane is cured to form the finished product. It is thought that the polyurea compound formed mechanically inhibits the polyurethane reaction, thereby extending the useful pot life of the mixture.

In view of the above, it will be realized that the secondary coating can be manipulated, the coating readily flowing on exertion of some pressure, then remaining in place and in the desired shape while sufficient energy is applied to effect a complete cure of the urethane system.

Those skilled in the art will readily devise numerous formulations utilizing the present invention, based on the foregoing description. By way of example, the following specific formulations are presented for a better understanding:

EXAMPLE I

| Component | Parts by Weight |
|---|---|
| 3600 mol wt. triol | 100.0 |
| Polyether diamine, 230 mol. wt. | 6.0 |
| Polyester Tackifying Resin (Sylvatack 25H) | 12.0 |
| Catalyst | 1.0 |
| Pigment | 1.0 |
| Diphenyl methane diisocyanate, or diphenyl methane polyisocyanate | 16.0 |

EXAMPLE II

| | |
|---|---|
| 3600 mol. wt. triol | 100.0 |
| Polyether diamine, 230 mol. wt. | 6.0 |
| Polyester tackifying resin | 12.0 |
| Catalyst | 1.0 |
| Pigment | 1.0 |
| Tolylene diisocyanate | 9.7 |

EXAMPLE III

| | |
|---|---|
| 3600 mol. wt. triol | 100.0 |
| Polyether diamine, 400 mol. wt. | 10.0 |
| Polyester tackifying resin | 10 to 20 |
| Catalyst | 1.0 |
| Pigment | 1.0 |
| Dyphenyl methane diisocyanate, or diphenyl methane polyisocyanate | 16.0 |

EXAMPLE IV

| | |
|---|---|
| 2800 mol wt. triol | 100.0 |
| Polyether triamine, 403 mol wt. | 5.0 |
| Polyester tackifying resin | 10 to 20 |
| Catalyst | 1.0 |
| Pigment | 1.0 |
| Dyphenyl methane diisocyanate, or diphenyl methane polyisocyanate | 16.0 |
| Pigment | 1.0 |
| Dyphenyl methane diisocyanate, or diphenyl methane polyisocyanate | 16.0 |

EXAMPLE V

| | |
|---|---|
| 3600 mol. wt. triol | 100.0 |
| Polyether diamine, 2000 mol. wt. | 20.0 |
| Polyester tackifying resin | 10 to 20 |
| Catalyst | 1.0 |
| Pigment | 1.0 |
| Dyphenyl methane diisocyanate, or diphenyl methane polisocyanate | 20.0 |

All of the above formulations provide a secondary, nonskid coating formulation that yields a fast reaction for forming the thixotropic gel, in conjuction with a slower reaction for forming the polyurethane. Those skilled in the art will realize that numerous other combinations of aliphatic or aromatic diamines or triamines can be selected to yield comparable results. The tackifying resin renders the secondary coating tacky, even after complete cure.

It has also been found that the tackiness of the secondary coating can be varied by varying the proportions of the isocyanate and the polyol that form the polyurethane. The conventional mix entails the use of one mole of the N=C=O part of the isocyanate molecule to 1 mole of the (OH) part of the polyol molecule. The tackiness increases as the molar quantity of the isocyanate is reduced, and the material can be formed to the quality of a pressure sensitive adhesive with sufficient reduction of the isocyanate. For the present invention, the greatest ratio found to be satisfactory is 0.75 mole of (N=C=O) to 1.0 mole of (OH). Beyond this limit, the secondary coating does not have the strength and stability required for carpets and the like.

Those skilled in the art will recognize that the basic polyurethane formulation provides a dense, tough elastomeric material. The small amount of catalyst indicates that the formulation will require a long time to cure without the application of additional energy. Further, it has been found that the diamine further retards the curing of the polyurethane material, so that external heat is a virtual necessity to the curing of the material.

In the context of the systems discussed in conjunction with the drawings, the lack of catalyzed curing is advantageous. This fact allows the secondary coating to be applied and manipulated as described. Only after all preliminary steps have been completed is the substrate with the coatings passed through a curing oven. Thus, the application and curing of the backings can be carefully controlled for the desired end product.

The product of the present invention can be a carpet having a precoat to lock in the yarns and having a secondary coat that provides a nonskid characteristic. The carpet can therefore be used as a car mat wherein the mat must remain in place under the driver's feet, or can be used as an entry mat wherein the mat must remain in place through heavy traffic. Other uses will suggest themselves to those skilled in the art.

The method of the present invention provides means for producing a carpet or the like wherein two separate coatings can be applied to a substrate, though it should be realized that the nonskid coating can be applied to a secondary backing. The precoat will normally be a smooth coating, and the nonskid coatings will normally be in stripes, areas or other predetermined pattern. The fact than the formulation for the nonskid coating is highly thixotropic allows a large amount of shaping or working of the coating to achieve the desired pattern, and the fact that the nonskid coating requires the application of external energy allows sufficient time to work the coating before curing.

It will of course be understood by those skilled in the art that the particular embodiments of the invention are presented by way of illustration only and are meant to be in no way restrictive; therefore, numerous changes and modifications may be made, and the full use of equivalents resorted to, without departing from the spirit or scope of the invention as outlined in the appended claims.

We claim:

1. A method for providing a nonskid coating on a substrate including the steps of providing a precoat coating for said substrate, said precoat coating being a uniform coating substantially sized for covering said substrate, said precoat coating comprising a first reactive formulation for forming a polyurethane and having a reaction time such that the application of external energy is needed to cure the first reactive formulation, providing a secondary coating comprising a second reactive formulation for forming a polyurethane, said second reactive formulation including a tackifier and having a reaction time such that the application of external energy is needed to cure the second reactive formulation, adhering said precoat coating to said substrate before said first reactive formulation is fully cured, and adhering said secondary coating to said precoat coating before said second reactive formulation is fully cured, said second reactive formulation including an amine for producing a polyurea compound for rendering said second reactive formulation thixotropic.

2. A method as claimed in claim 1, wherein the step of adhering said precoat coating to said substrate comprises the steps of placing said reactive formulation for providing said precoat coating, urging said substrate towards said belt for marrying said substrate and said coating, and further including the step of heating said belt with said substrate and coating for at least partially curing said precoat coating.

3. A method as claimed in claim 2, wherein the step of adhering said secondary coating to said precoat coating includes the steps of removing said substrate with said precoat coating from said belt, inverting said substrate so that said precoat coating faces upwardly, dispensing said second reactive formulation onto said precoat coating and subsequently manipulating said second reactive formulation for providing a selected pattern of said reactive formulation and further including the step of heating said precoat and said secondary coatings for fully curing both said coatings.

4. A method as claimed in claim 1, wherein the step of adhering said secondary coating to said precoat coating comprises the steps of dispensing said second reactive formulation onto a belt and forming said second reactive formulation into said secondary coating, subsequently dispensing said reactive formulation onto said belt over said secondary coating and forming said reactive formulation onto said precoat coating.

5. A method as claimed in claim 4, and further including the steps of urging said substrate against said precoat coating, and subsequently heating both said coatings sufficiently to cure both said coatings.

6. A method for providing a nonskid coating on a substrate including the steps of preparing a reactive formulation for forming a polyurethane, said reactive formulation including a tackifier for rendering the cured polyurethane permanently tacky, said reactive formulation further including an amine for forming a polyurea compound, forming a thixotropic gel through fast reaction of said amine for forming a polyurea compound, and subsequently heating said reactive formulation for forming a polyurethane and for curing said polyurethane.

7. A method as claimed in claim 6, and further including the step reducing the molar quantity of isocyanate with respect to the molar quantity of polyol for increasing the tackiness of said polyurethane.

8. A method as claimed in claim 6, and further including the step of mechanically manipulating said reactive formulation after the step of placing said reactive formulation on a substrate and before the step of heating said reactive formulation.

9. A method as claimed in claim 8, and further including the steps of providing a precoat coating on said substrate before the steps of placing said reactive formulation on said substrate.

10. A method as claimed in claim 9, and further including the step of at least partially curing said precoat coating prior to the step of placing said reactive formulation on said substrate.

11. A carpet having a nonskid coating, said carpet including a carpet backing having face yarns sewn therein, a precoat adhering said face yarns to said backing, and a secondary coating adhered to said precoat, said secondary coating comprising a polyurethane including a tackifier for rendering said secondary coating permanently tacky, said polyurethane of said secondary coating being the result of a reaction of an isocyanate, a polyol, and an amine, said isocyanate being reduced for enhancing the tackiness provided by said tackifier.

12. A carpet as claimed in claim 11, and further characterized in that said secondary coating is formed into a pattern.

13. A carpet as claimed in claim 12, said amine being selected from the group consisting of a polyether diamine having a molecular weight of 230, polyether diamine having a molecular weight of 400, polyether triamine having a molecular weight of 403 and polyether diamine having a molecular weight of 2000.

14. A carpet as claimed in claim 13, wherein said isocyanate is reduced such that the mol ratio of the N=C=O part of the said isocyanate to the OH part of the said polyol is 0.75–1.0:1.

* * * * *